US006039646A

United States Patent [19]

Sells

[11] Patent Number: 6,039,646

[45] Date of Patent: Mar. 21, 2000

[54] VENTILATING CAP FOR COVERING A VENT OPENING, TRANSPORT CONTAINER, AND METHOD FOR THEIR MANUFACTURE

[75] Inventor: Gary L. Sells, Mishawaka, Ind.

[73] Assignee: Cor-A-Vent, Incorporated, Mishawaka, Ind.

[21] Appl. No.: 09/034,480

[22] Filed: Mar. 4, 1998

Related U.S. Application Data

[60] Provisional application No. 60/069,527, Dec. 12, 1997.

[51] Int. Cl.[7] ..... F24F 7/02

[52] U.S. Cl. ..... 454/365; 52/199

[58] Field of Search ..... 454/365; 52/57, 52/199

[56] References Cited

U.S. PATENT DOCUMENTS

| | | | |
|---|---|---|---|
| 561,734 | 7/1896 | Morris | 454/365 |
| 1,020,923 | 3/1912 | Mueller et al. . | |
| 2,029,394 | 2/1936 | Sidebotham . | |
| 2,030,979 | 2/1936 | Fuller | 229/15 |
| 2,083,623 | 6/1937 | Thorup | 229/6 |
| 2,160,221 | 5/1939 | Masters et al. | 229/14 |
| 2,657,044 | 10/1953 | Apgar | 270/61 |
| 3,126,867 | 3/1964 | Kundikoff . | |
| 3,913,822 | 10/1975 | Heaps, Jr. | 229/23 |
| 4,606,461 | 8/1986 | Bolton, Sr. . | |
| 4,817,506 | 4/1989 | Cashman | 98/42.21 |
| 5,054,254 | 10/1991 | Sells | 52/199 |
| 5,304,095 | 4/1994 | Morris | 454/365 |
| 5,331,783 | 7/1994 | Kasner et al. | 52/199 |
| 5,372,570 | 12/1994 | Schmidtke et al. | 493/399 |
| 5,466,211 | 11/1995 | Komarek et al. | 493/355 |

FOREIGN PATENT DOCUMENTS

| | | |
|---|---|---|
| 697347 | 11/1964 | Canada . |
| 2688199 | 9/1993 | France . |
| 1017013 | 8/1954 | Germany . |
| 6406385 | 6/1963 | Netherlands . |

*Primary Examiner*—Harold Joyce
*Attorney, Agent, or Firm*—Baker & Daniels

[57] ABSTRACT

Ventilating material for covering a vent opening in a roof consists of multiple panels that interconnect with each other to condense the venting material for transport by permitting it to be folded into multiple layers. A fastening band extends around all but one of the panels and a second fastening band extends around all of the panels to thereby hold the panels together for transport. After the bundle is placed on the roof of a building structure, the second fastener is released to release the first panel, while the remaining panels remain bundled together by the other fastener. The method of creasing and folding the materials to permit multiple ply corrugated material to be folded to form the bundle of venting material is also disclosed. The folding process may also be used, according to still another aspect of the invention, to make a transport container of multiple ply corrugated material.

16 Claims, 14 Drawing Sheets

VENTILATING CAP FOR COVERING A VENT OPENING, TRANSPORT CONTAINER, AND METHOD FOR THEIR MANUFACTURE

This application claims domestic priority based on the provisional application Ser. No. 60/069,527, filed Dec. 12, 1997.

This invention relates to a ventilating cap for covering a vent opening which is made from multiple ply corrugated material, a transport container having side walls made out of a multiple ply corrugated material, and a method of folding multiple ply corrugated material used in the manufacture of the ventilating cap and the transport container.

Ventilating caps that cover the vent opening on the ridge of a roof are disclosed in U.S. Pat. Nos. 3,949,657; 5,092,225; and 5,304,095. These caps are made of multiple plies of a corrugated material, the passages defined by the corrugations providing a vent path from the attic and preventing moisture and insects from entering the structure. It is desirable that the attic or upper story of the building or structure be vented to atmosphere to prevent heat build up within the structure. The ventilating cap includes vent parts that are applied on either side of the ridge of the vent and are connected by an upper layer of the corrugated material.

The ventilating material must be carried to the roof for installation over the vent opening. The aforementioned corrugated venting material is usually packaged in bundles of four foot panels, and each panel is then installed separately. Each succeeding panel must be manually aligned with the preceding panel, and individually nailed in place. Care must be taken that unattached panels do not fall from the roof. Accordingly, installation of the corrugated type of building materials must be skillfully accomplished.

Another way of packaging ventilating material, both the corrugated type and a more flexible, batt material product comprising randomly arranged fibers, is to roll the product in a roll and secure the roll with a fastener. After the roll is transported to the roof of the structure, the fastener is released and the material is rolled out, aligned, held in place, and then secured to the roof by, for example, nailing or stapling. The roll of material can easily fall off of the roof, and it is extremely difficult to maintain alignment of the material as it is secured in place. As a practical matter, installation of this type of material requires two workers.

According to the present invention, five or more four foot panels each connected to an adjacent panel through transverse folds are bundled together for transport. Preferably, bundles are held together by flexible shipping bands. Two or more bands are used to secure each bundle. One of the bands extends around a portion (less than all) of the panels, leaving at least one of the outer panels unattached. A second band extends around all of the panels. Accordingly, the bundle can be transported to the roof and the second band released, thereby releasing one of the outer panels while the first band secures the remaining panels in a bundle. The installer then secures the panel that has been released in place on the roof, such as by nailing, before the other band is released. Accordingly, the remaining panels remain bundled together while the workman secures the outer panel in place. After the outer panel has been secured in place, the other band is released, and the remaining panels are stretched out over the ventilating opening, thereby forming an interconnected, longitudinal run of venting material. Since all of the remaining panels are connected to each other and to the outer panel, alignment is relatively easy, the first panel having already been secured in place. Since the remaining panels are connected together by transverse creases, the alignment of the remaining panels is effected merely by stretching them out on the roof. Each succeeding panel then can be secured in place. Of course, three or even more bands may be used, each securing a progressively greater number of panels, with at least one band securing all of the panels together.

It is necessary that the panels be folded when they are bundled without permanently collapsing the passages defined by the corrugation. Accordingly, another aspect of the present invention is to provide a method of folding multiple ply corrugated material in such a way that the folds may be consistently made in the proper place and that the material not be torn when the material is folded. According to the invention, a cylindrical die is pressed into the corrugated material a sufficient distance that a depression or crease is formed in the material without pressing the die so that the material is creased all the way through. The material can then be folded about the crease to form a bundle of corrugated material as discussed above. Since at least the outermost ply of the material must stretch as the material is folded, it is preferable that the die not pressed so that the crease is not formed all the way through the material. The material is a high density corrugated polyethylene and has a "memory" such that after the cylindrical die is removed from the material, the crease remains so that the material may be consistently folded without damage to the material. Preferably, the cylindrical die used to form the crease or depression has a radius substantially equal to the thickness of the material. Accordingly, a crease of sufficient size is formed to permit a fold to bring one panel against the other panel without damaging the material. After the material is unfolded as it is being installed on the roof, the crease progressively "relaxes", permitting the corrugations to open thus providing venting.

According to another embodiment of the invention, ventilating material is rolled into a roll consisting of concentric layers held together by a fastener such as a shipping band that extends from the center of the roll over the outer layer, and by at least one other band extending from the center of the roll across one of the layers between the center and the outer layer. Accordingly, the roll can be transported to the roof, the outer band cut, the material released by cutting of the outer band can be secured in place over the ventilating opening, and the remaining bands can be cut successively so that the material may be unrolled over the vent opening, alignment being established by securing the layer released by the outer band to the roof before the remaining bands are released.

According to another aspect of the present invention, corrugated material is creased and folded to make transport containers, in which products are stored in bulk for shipment. The multiple ply corrugated polyethylene material is extremely rugged, and, because of the method disclosed hereinabove for making consistent folds in the material, can be used for side walls in such transport containers. The side walls formed of the multiple ply corrugated material is mounted on a standard wooden pallet which forms the bottom of the receptacle.

These and other features of the present invention will become apparent from the following description, with reference to the accompanying drawings, in which.

Figure 1:
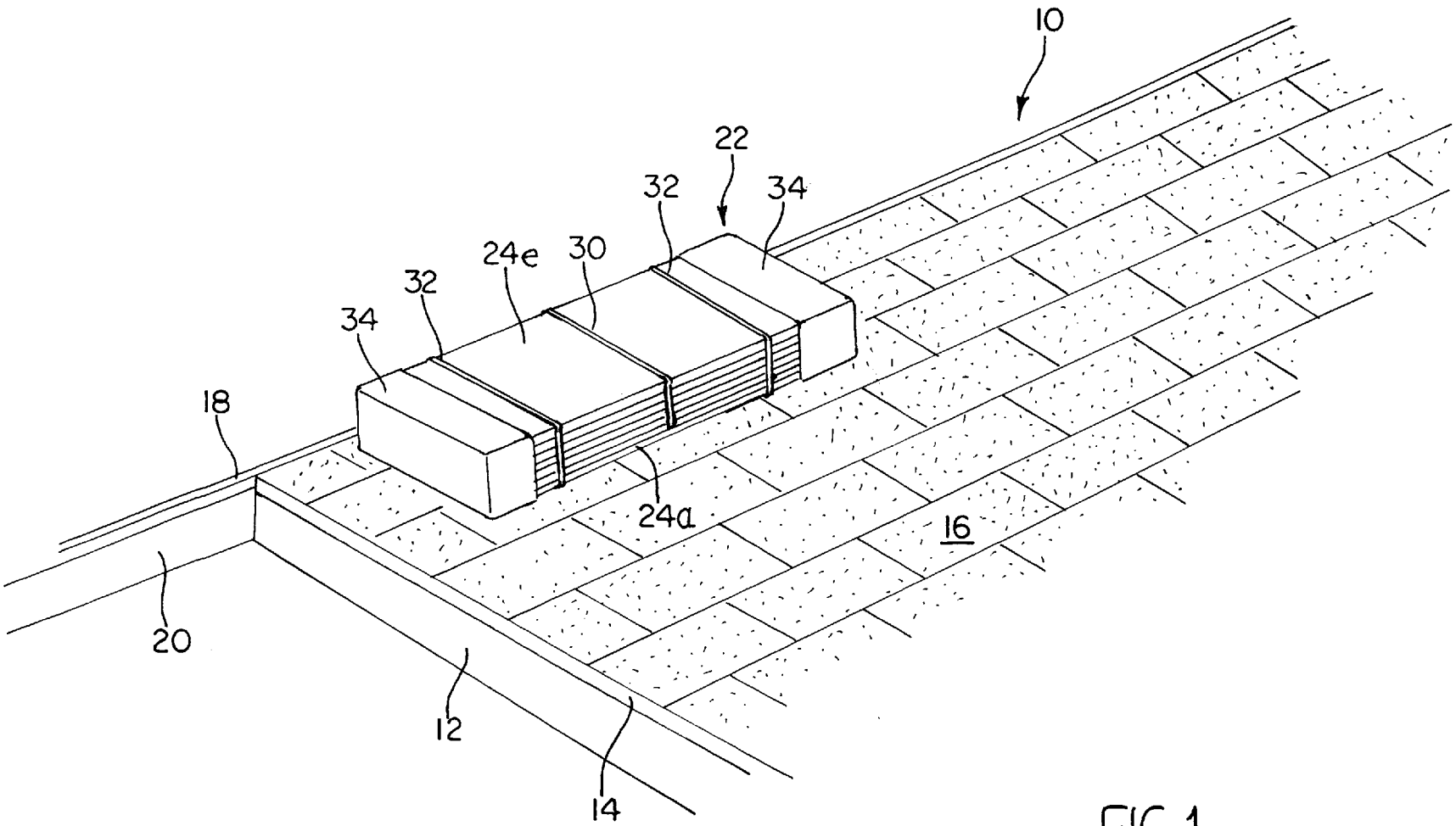
FIG. 1 is a view in perspective of a portion of the roof of a building structure with venting material packaged for transport according to the present invention placed on the roof adjacent the vent opening cut therein.

Referring now to the drawings, and particularly FIG. 1 thereof, a pitched roof generally indicated by the number 10 of a building structure includes inclined rafters 12 which support underlayment 14 upon which shingles 16 are applied. A ventilating opening 18 is cut along the ridge of the roof, on both sides of the ridge board 20, which extends along the ridge of the roof.

Figure 5:
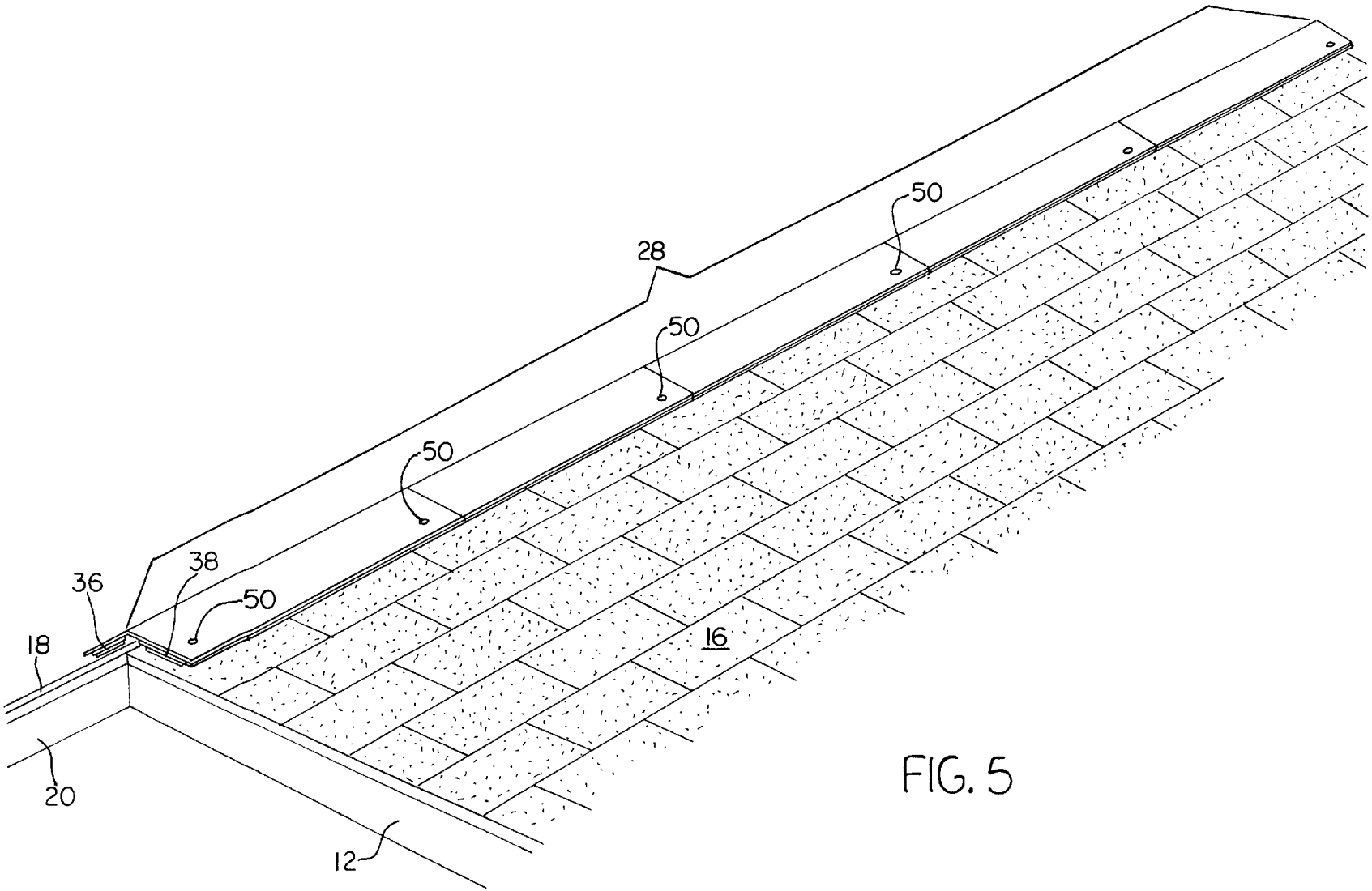
FIG. 5 is a view similar to FIG. 1, but illustrating the venting material after it is applied to the roof.

A bundle of ventilating material generally indicated by the numeral 22 is shown in FIG. 1 placed on the roof adjacent the ventilating opening 18. The bundle 22 consists of multiple panels 24*a–e,* each of which are attached to an adjacent panel by transversely extending crease lines 26*a–d* to permit each of the panels to be folded about an end of an adjacent panel to overlie the adjacent panel when the ventilating material is gathered in the bundle 22 for transport. The creases 26*a–d* are formed, for example, by applying an arcuate pressure die across the width of the material. The corrugations will be crushed as the material is compressed by the die, and will relax somewhat after being compressed, but will have sufficient "memory" to permit folding. The panels 24*a* and 24*e* are end panels, with the panels 24*b,* 24*c* and 24*d* extending between the end panels 24*a* and 24*e* so that, when the panels are fully extended as indicated in FIG. 5, the panels 24*a–*24*e* form a run of ventilating material that covers the ventilating opening 18. Commonly, each of the panels 24*a–*24*e* is about four feet long, so that the run of ventilating material indicated by the numeral 28 in FIG. 5 is about 20 feet long. Additional runs of ventilating material can, if necessary, be extended from the run of 28. Accordingly, the venting material can be condensed for transport as illustrated in FIG. 1 in which the panels 24*a–e* overlie each other but can be extended when the ventilating material is mounted on the roof to form a run of ventilating material 28.

Referring now to FIG. 1, the panels 24*a–e* are secured for transport by a fastener generally indicated by the numeral 30, and one or more additional fasteners, generally indicated by the numeral 32. Fasteners 30 and 32 may be, for example, common banding, strapping or tape that is commonly used to secure articles for transport and is well known to those skilled in the art. The fasteners, 30, 32 can be made out of plastic, metal, or any other suitable material sufficiently strong to secure the bundle 22 against the rigors of transport. Alternatively, edge clamps may be used to secure the panels together. The fastener 30 fastens the panels 24*b–e* together, but leaves the panel 24*a* free. The fasteners 32 extend around all of the panels 24*a–*24*e.* Accordingly, after the fasteners 32 are released or cut, only panel 24*a* will be released from the bundle, but the panels 24*b–*24*e* will be secured together by the fastener 30. However, the panel 24 a remains attached to the bundle through the crease 26*a.* It is within the scope of the invention to further subdivide the panels by, for example, providing additional fasteners which secure even fewer of the panels together. Decorative end caps 24, which may be made of cardboard or the like, are installed over the ends of the bundle 22, and may bear, for example, instructions, identifying logos, etc. The end caps 34 are provided only to display such information, and form no part of securing the bundle 22 together.

Figure 6:
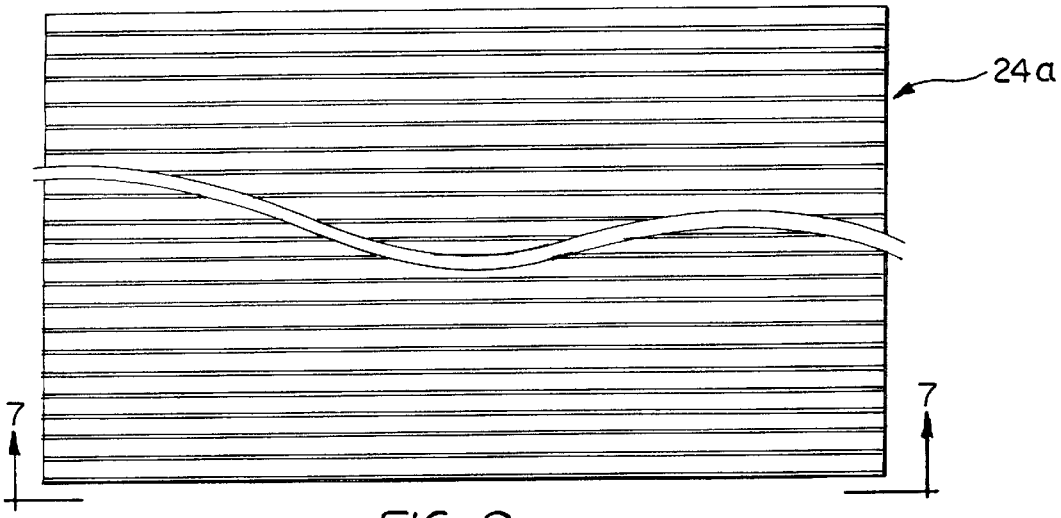
FIG. 6 is a top plan view of one type of venting material used in FIGS. 1–5.
Figure 7:
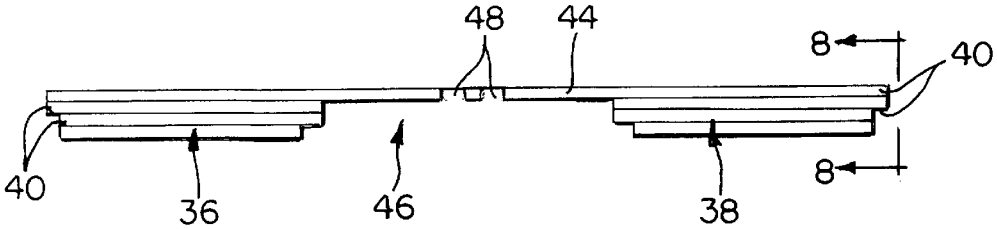
FIG. 7 is a view taken substantially along line 7—7 of FIG. 6.
Figure 8:
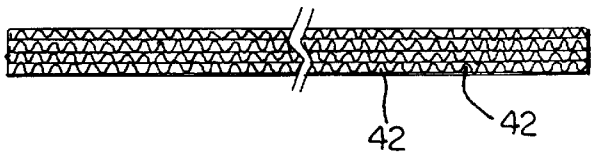
FIG. 8 is a view taken substantially along line 8—8 of FIG. 7.

Referring now to FIGS. 6–8, the panel 24*a,* which is taken as typical of the panels 24*a–e,* will be described in detail. Panel 24*a* includes vent parts 36 and 38 each of which consist of plies 24 of a corrugated material which defines passages 42 (FIG. 8) thereby communicate the vent opening 18 with ambient atmosphere. The lowermost ply 40 of the vent parts 36–38 is applied against the shingles 16 and the upper ply 44 of both of the vent parts 36, 38 bridges between the vent parts such that the vent parts 36, 38 define a gap 46, therebetween. A groove 48 is cut in the upper ply 44 to permit the upper ply to be creased longitudinally, thereby permitting the ventilating cap to be installed on the roof as illustrated in FIG. 5 with the vent part 38 on one side of the vent opening cut along the ridge of the roof and the vent part 36 installed on the opposite side of the vent opening.

Figure 2:
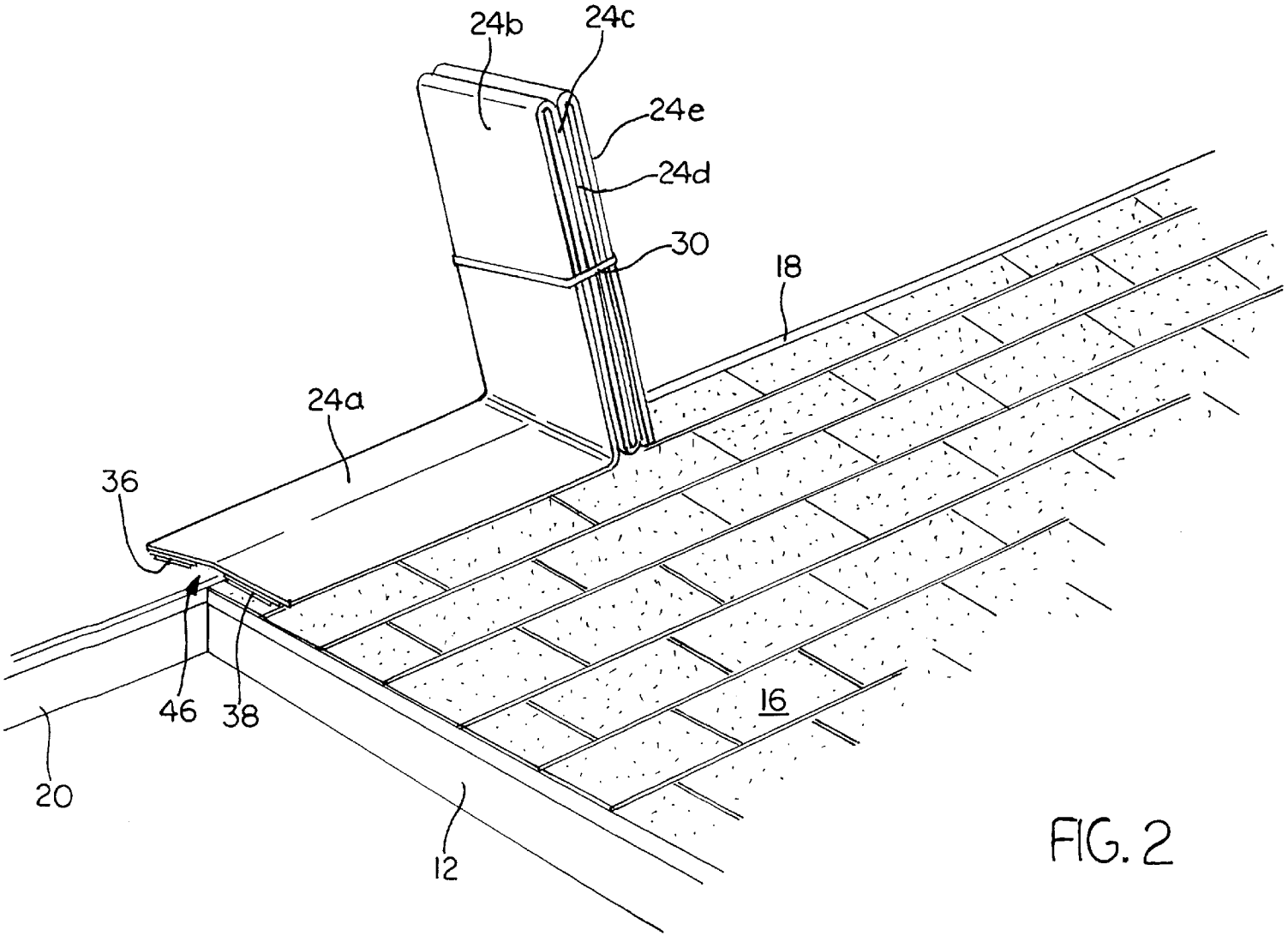
FIG. 2 is a perspective view similar to FIG. 1, but illustrating one step in the installation of the ventilating material on the roof.
Figure 3:
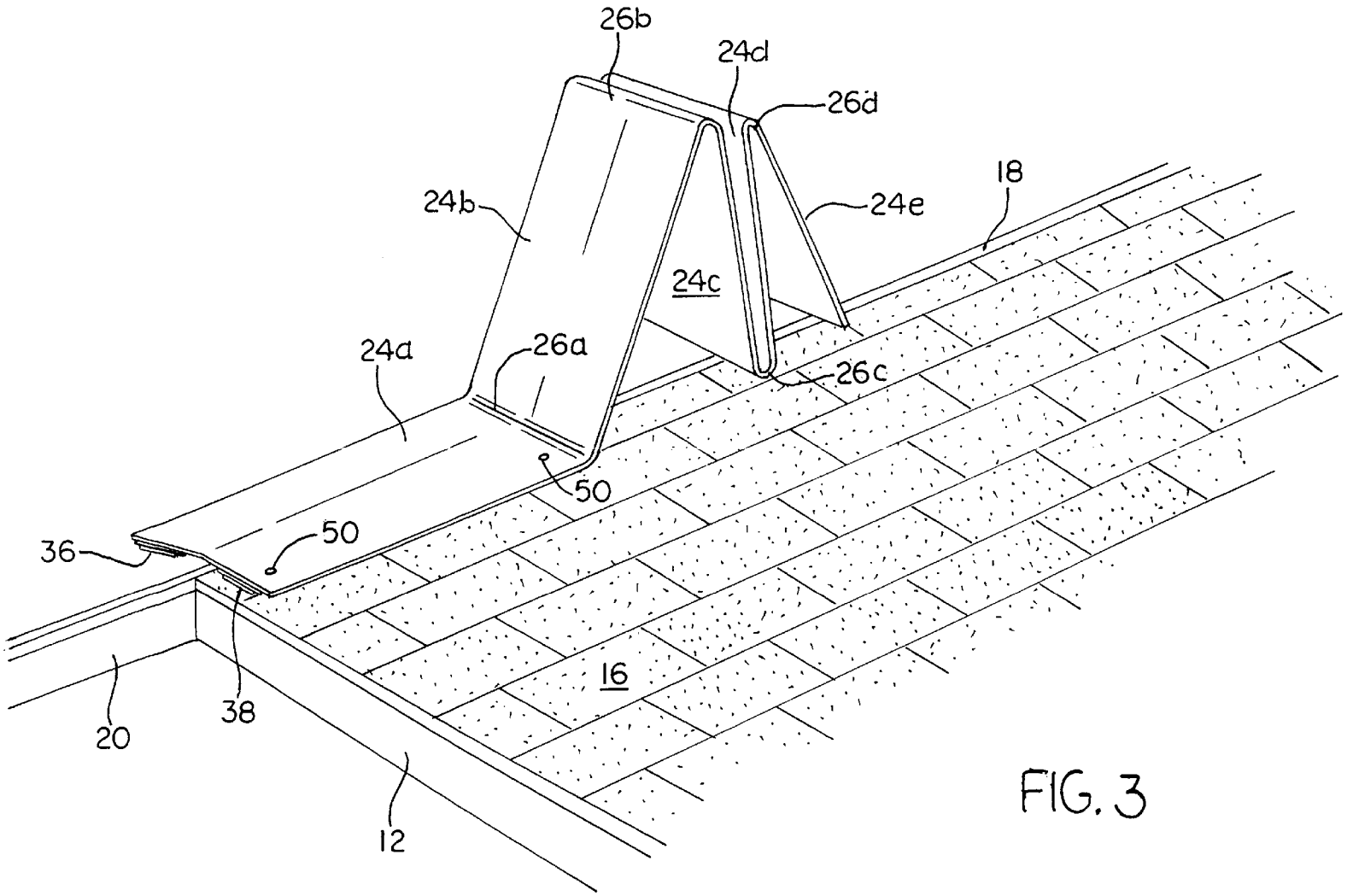
FIG. 3 and 4 are views similar to FIG. 2, but illustrating further progressive steps required in the installation of ventilating material on the roof of the building structure.
Figure 4:
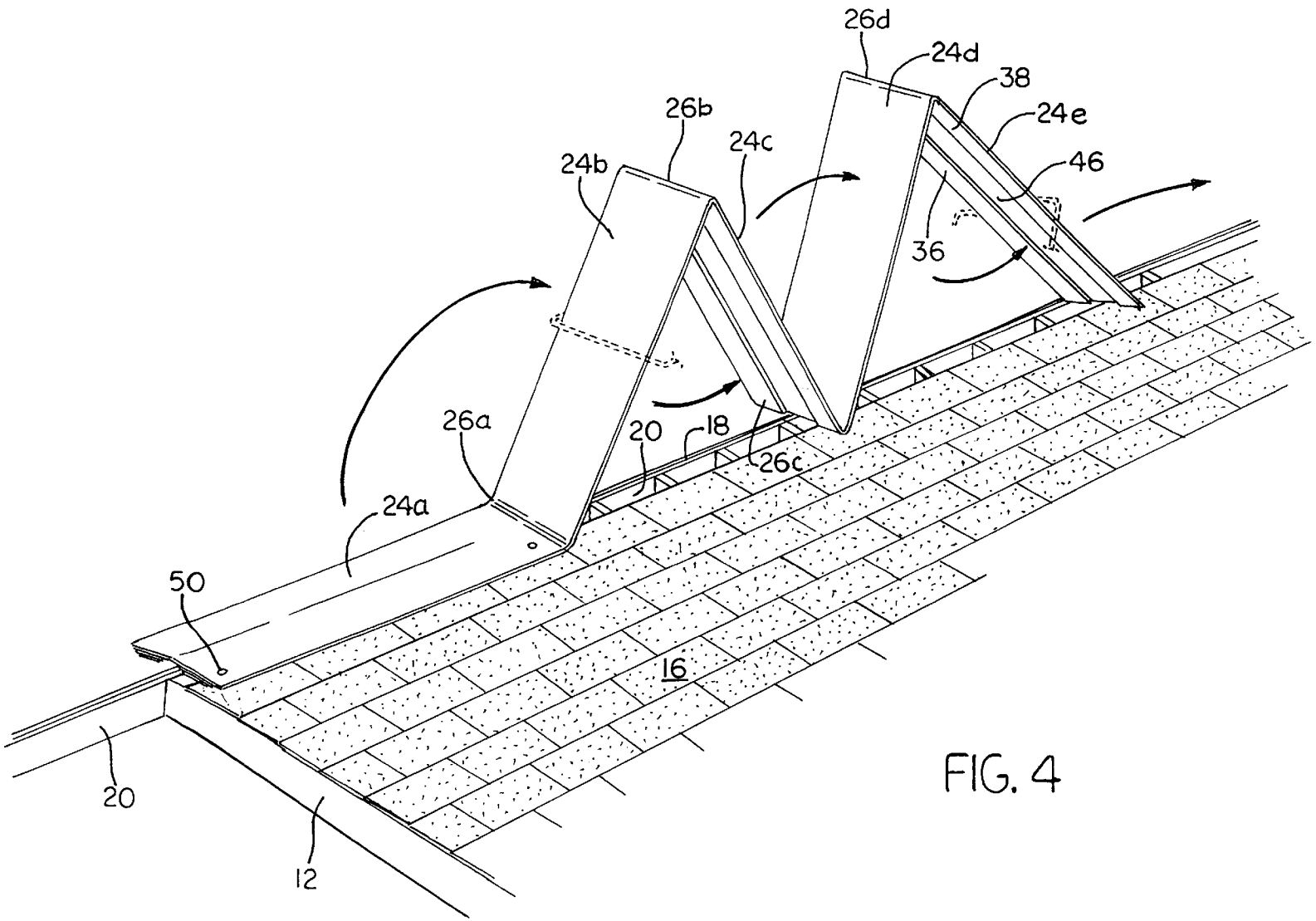

Referring now to FIG. 2, the ventilating cap is installed by first removing and discarding the end caps 34, and by releasing the fasteners 32, which capture all of the panels 24*a–e.* Accordingly, the panel 24*a* can be placed as illustrated in FIG. 2, while the fastener 30 cures the remaining panels 24*b–*24*e* together. Since the panels must be installed on the roof with the gap 46 facing toward the ventilation opening 18, it is important that when the panels are bundled at their place of manufacture that groove 46 of at least one of the panels face outwardly. The bundle 22 is then transported and placed on the roof as illustrated in FIG. 1, with the panel 24*a* with the gap 46 facing outwardly placed on the bottom. The installer can then manipulate the bundle after releasing the fasteners 32 to position and align the panel 24*a* in the proper positions. Panel 24*a* can then be secured in place after the panel 24*a* is properly positioned and aligned by appropriate fasteners, such as roofing nails 50, which are illustrated in FIG. 3 as securing one of the vent parts 38 to the roof. This is sufficient to maintain the panel 24 in its properly aligned position. The fastening band 30 is then released, thereby releasing the remaining panels 24*b–e*. Because all the panels are attached to each other through the crease lines 26, and since the panel 24*a* has already been installed in the proper position, the remaining panels can be properly positioned and aligned as illustrated in FIGS. 3 and 4 by merely stretching out the panels along the ridge of the roof. By leaving the fastener 30 intact until after the panel 24*a* is installed, handling of the ventilating material is simplified, and it is much easier to assure that the ventilating material does not fall off of the roof. After the fastener 30 is released, it is a simple matter to stretch the ventilating material out along the ridge line, and to apply additional fasteners 50 to install the material along the ridge line, as illustrated in FIG. 5. The fasteners 50 are used to secure both of the vent parts to the roof.

Figure 9:
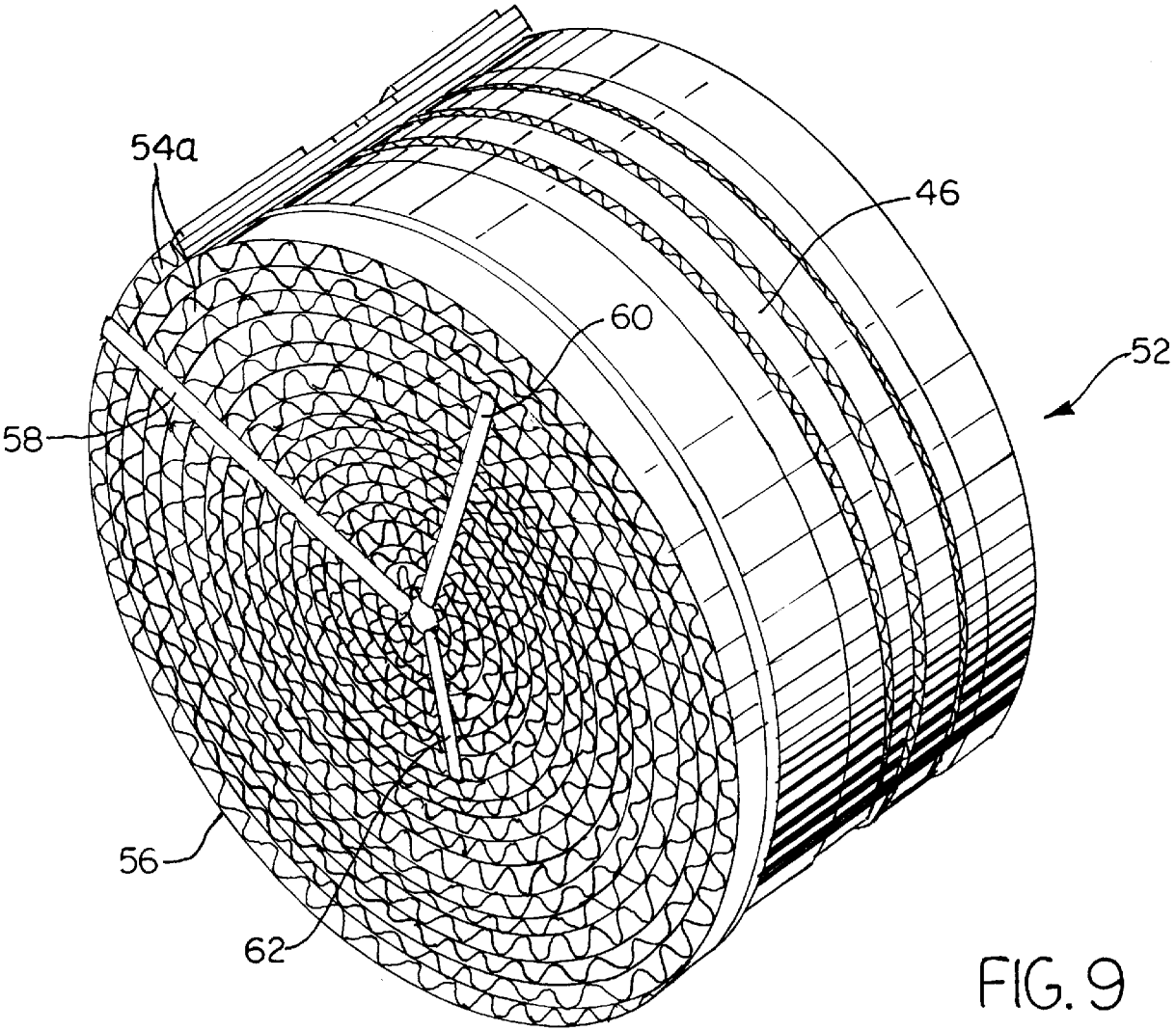
FIG. 9 is a view in perspective of venting material rolled up into a roll and secured for transport according to the teaching of the present invention.
Figure 11:
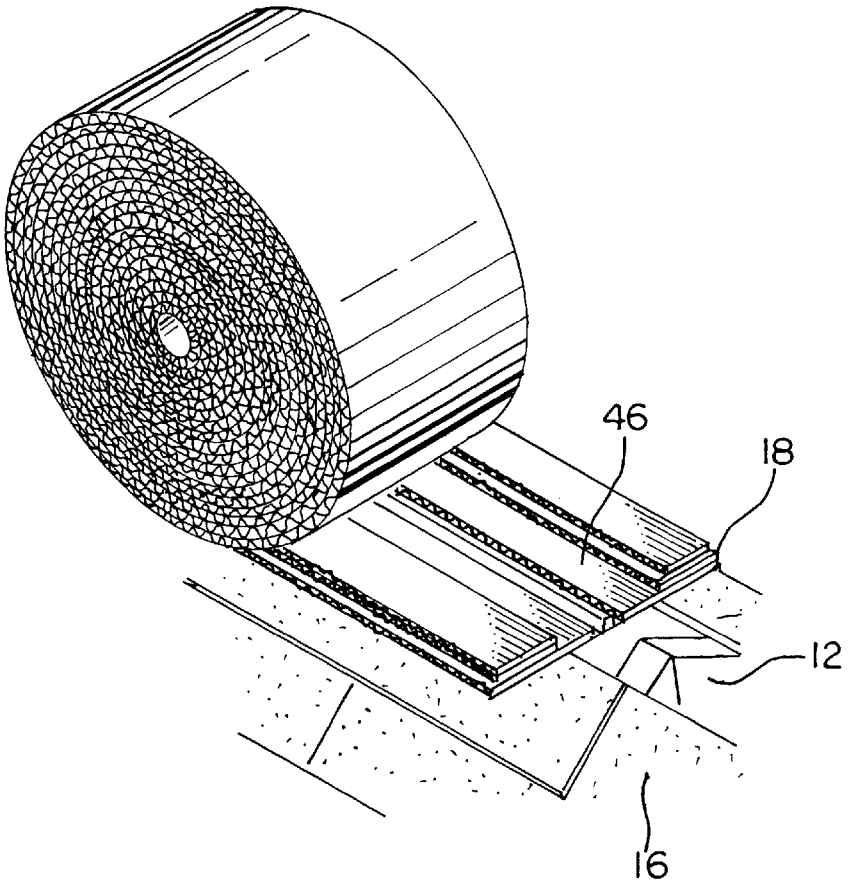
FIG. 11 is a view similar to FIG. 10, but illustrating an incorrect way of applying the venting material illustrated in FIG. 9 to the roof of a building structure.
Figure 10:
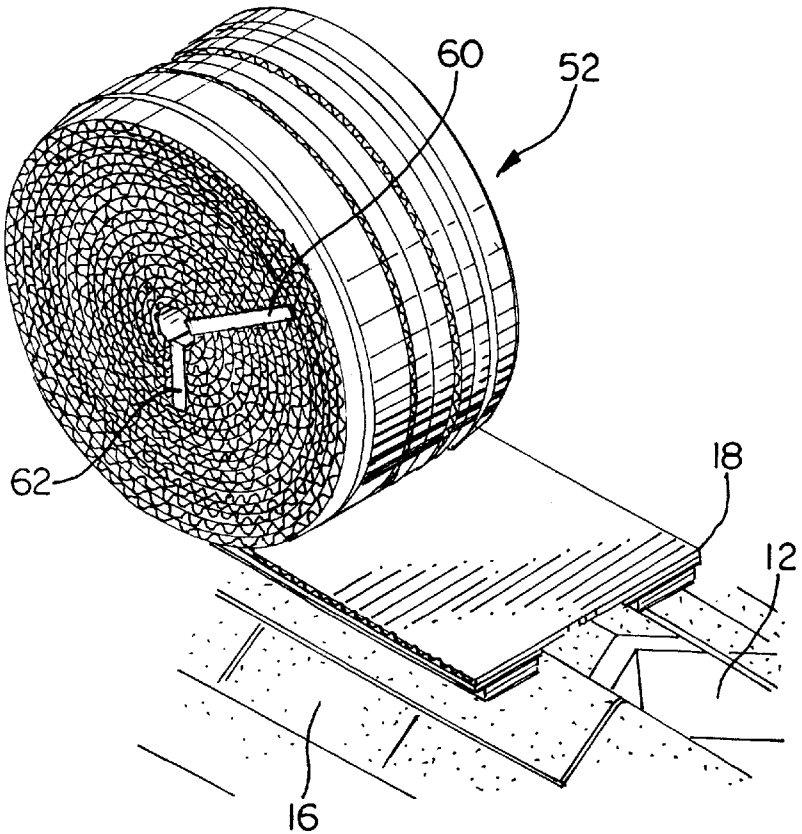
FIG. 10 is a view in perspective illustrating the manner in which the venting material illustrated in FIG. 9 is applied to the roof of the building structure.

Referring now to FIGS. 9–11, a roll of venting material 28 is rolled into a roll generally indicated by the numeral 52, with the gap 46 facing radially outwardly. Accordingly, the run of venting material 28 is rolled into successive concentric layers 54 which are concentric about the center 56 of the roll 52. Fasteners 58, 60 and 62, which are made of a material similar to that of the fasteners 30 and 32 are used to secure the roll 52 for shipping. The fastener 58 extends radially outwardly from the center 56, then transversely across the outer periphery of the roll 52, and then radially inwardly on the other side of the roll (not shown) and through the center 56. The fasteners 60 and 62 extend between intermediate layers 54, the fastener 60 extending between layers 54 at a greater radial distance from the center 56 than those between which the fastener 52 extends. Other than their length, the fasteners 58, 60 and 62 may be identical.

Venting material for installation along the ridge of a roof has been provided in rolls before, but the material must be stretched out along the roof and held in place while the material was installed. As a practical matter, the job required at least two installers, since alignment and maintenance of material on the roof was difficult. According to the present invention, the roll 52 is placed on the roof and the fastener 58 is released. As illustrated in FIG. 10, since the gap 46 faces radially outwardly, the roll can be placed on the roof, the fastener 58 released, and the first few layers 54 unrolled directly over the ventilating opening 18. Appropriate fasteners such as nails 50 can then be used to secure the material to the roof after it is first positioned and aligned. Since the fasteners 60 and 62 keep the bulk of the roll together other than the first few layers that are rolled out for immediate installation, the installer installing the material can easily position and maintain the relatively large roll 52 in place over the ventilating opening. After the initial portion of the roll 52 is aligned and a sufficient number of fasteners are installed to secure that portion of the run of ventilating material the next fastener 60 is released, and the roll 52 is unrolled an additional distance. Additional fasteners are then installed to secure that portion of the ventilating material to the roof. Finally, the fastener 62 is released, permitting the rest of the roll 52 to be unwound and installed on the roof.

It has heretofore been common practice for ventilating materials supplied in rolls to roll the ventilating material such that the gap 46 faces inwardly, such that the flat outer ply 48 forms the outer portion for appearance purposes. However, as illustrated in FIG. 11, when this is done the roll must be turned over in order to install the material with the gap 46 facing downwardly into the vent opening 18. For that reason, it is preferable to roll the roll as illustrated in FIG. 9 with the gap 46 facing outwardly.

Figure 12:
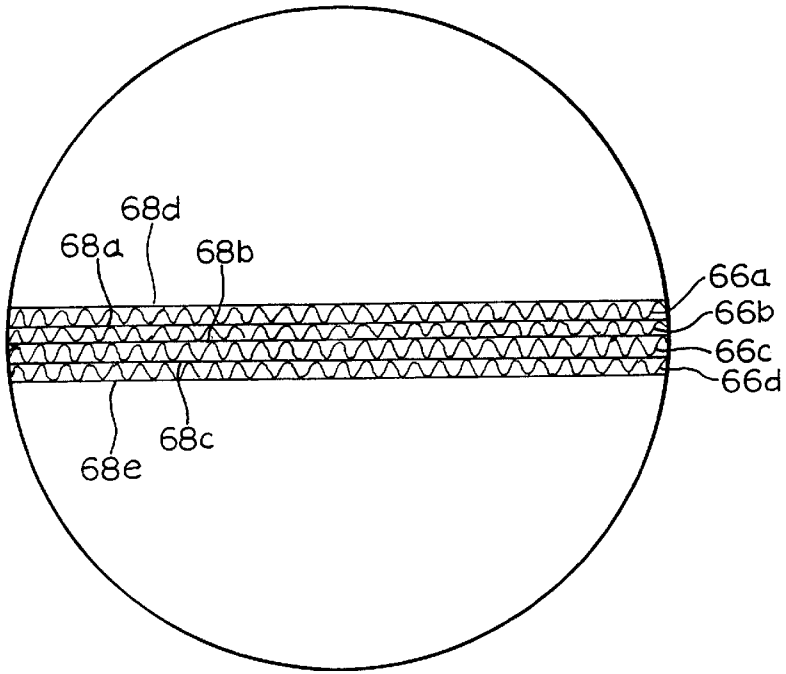

Referring now FIGS. 12–17, the manner in which the corrugated material is folded so that the panels 24*a–e* may be folded against one another will now be described in detail. Referring to FIG. 12, corrugated material generally indicated by the numeral 64 consists of corrugated plies 66*a*, 66*b*, 66*c* and 66*d* separated by planar sheets 68*a*, 68*b*, and 68*c*. Outer sheets 68*d* and 68*e* define the top and bottom of the material. Both the corrugated layers 66*a–*66*d* and the sheets 68*a–*68*e* are made out of a conventional, high density, polyethylene material which is readily available in single plies to those skilled in the art. The plies are layered up to form the multiply ply corrugated material indicated by the numeral 64 and are fastened together by any convenient means, such as by stapling (not shown).

Figure 13:
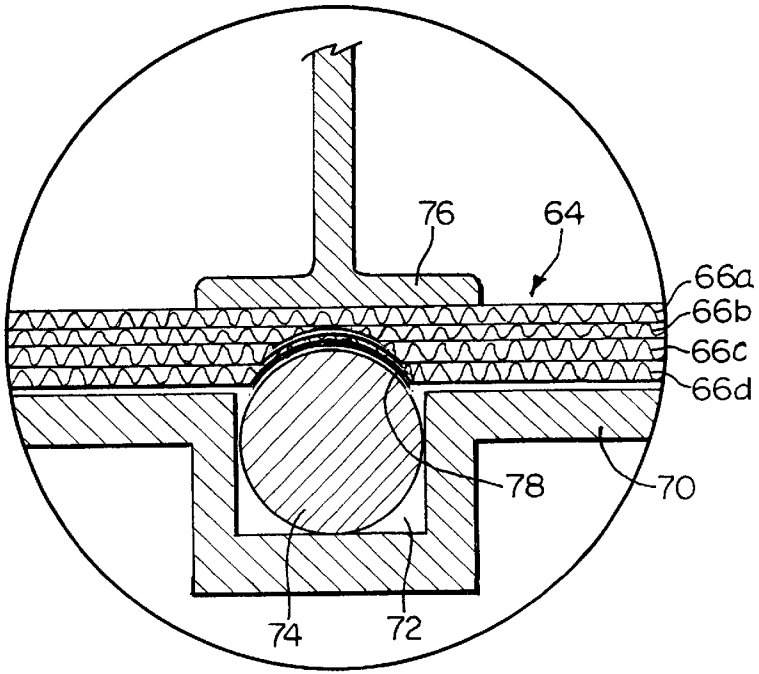
FIGS. 12–17 are cross sectional views taken through corrugated material and illustrating the progression of operations used according to the present invention in folding the multiple plied corrugated material.
Figure 14:
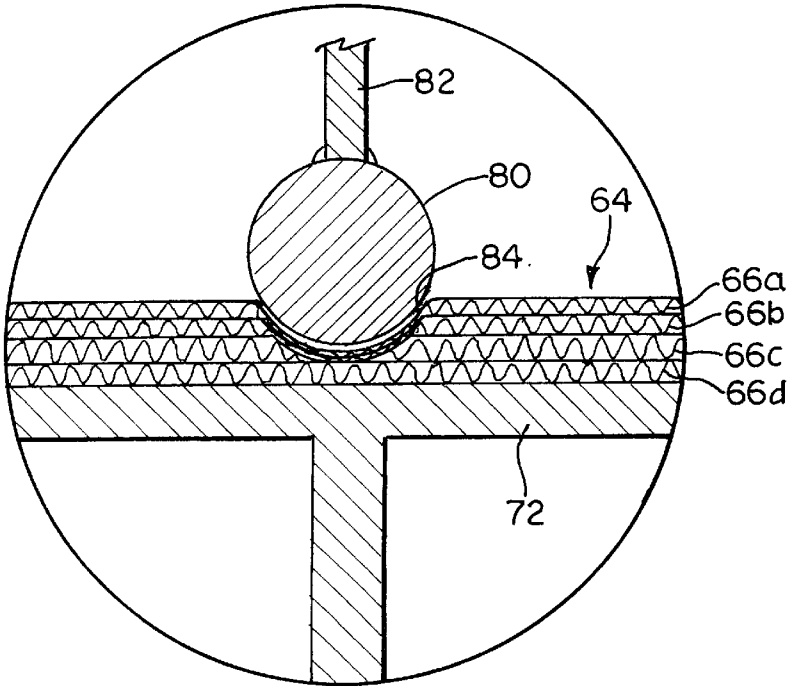

Multiple ply corrugated material 64 is folded by first forming creases or depressions in the material extending into the material from the side of the material 64 sections of which are to be folded toward on another. Accordingly, the depression or creases control compression of the inner plies which face into the fold, and while still permitting stretching of one or more of the outer plies as the material is folded. As shown in FIG. 13, the material 64 is placed on a substantially flat table 70 having recesses 72 in which a cylindrical die 74 is placed. The radius of the die 74 is substantially equal to the thickness of the material 64. A pressure pad 76 is forced against the material 64 so that the die 74 forms a crease or depression 78 in the material 64 which extends into the plies 66*d*, 66*c* and 66*b* to compress the latter to thereby form the crease 78. It will be noted that the ply 66*a* is left uncompressed. Referring now to FIG. 14, the material 64 remains placed on the table 72 while a crease or depression is made that allows folding in the opposite direction, so that the material can be folded to form the panels 24*a–e* discussed above. A cylindrical die 80, which is identical to the die 74, is mounted on a pressure member 82 which is moveable toward and away from the table 72. Accordingly, pressure member 82 is operated to force the cylindrical die 80 into the material 64 to an extent that the layer ply 66*a–*66*c* are compressed to form the depression 84.

Figure 15:
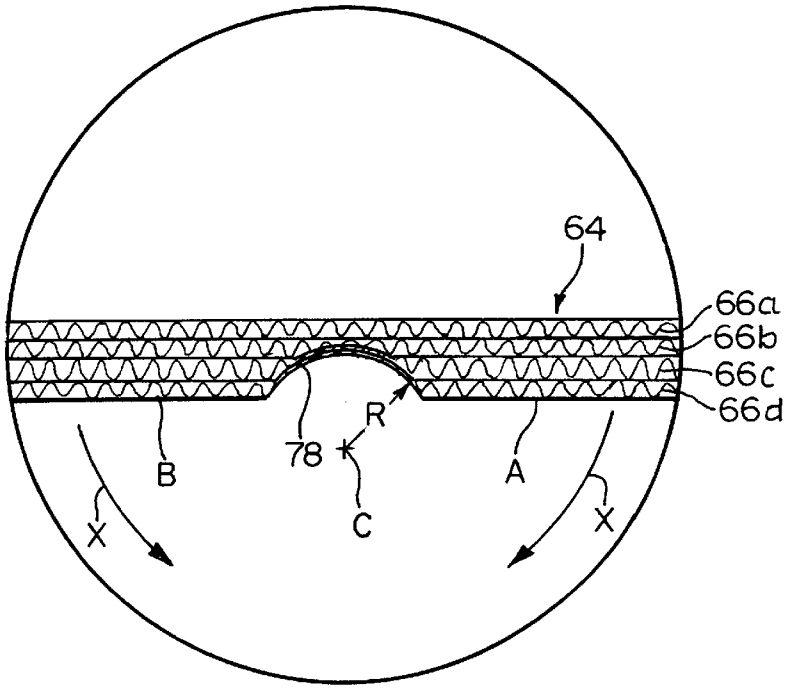
Figure 17:
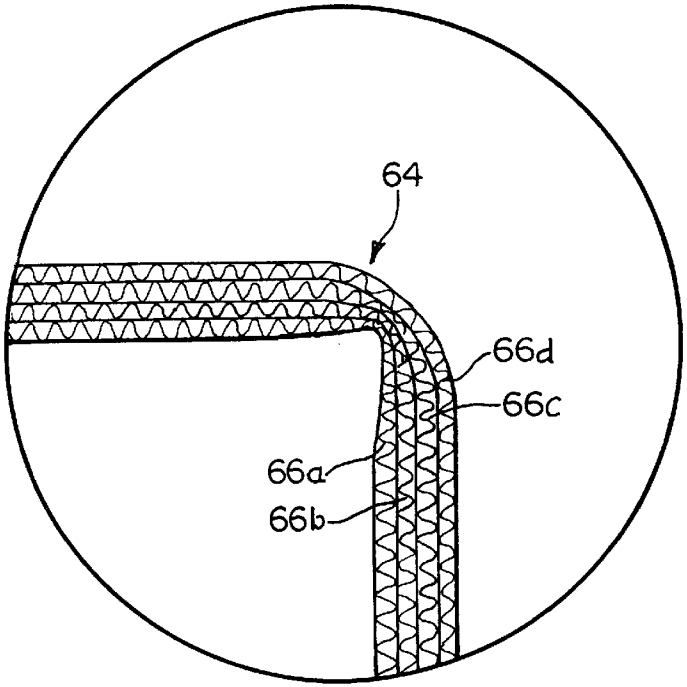
Figure 16:
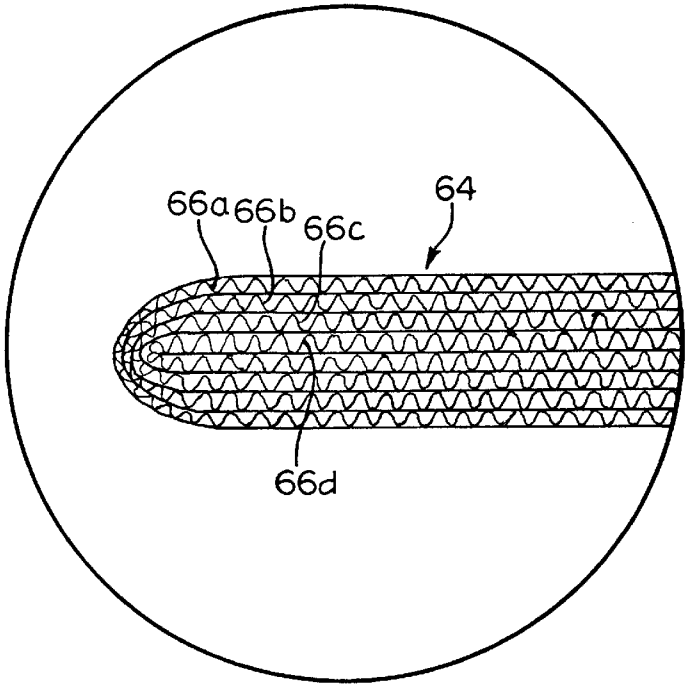

Referring now to FIG. 15, after the depressions are formed in the material from which the panels 24*a–e* are to be folded, the material is removed from table 72. Because the high density polyethylene material has a "memory", the depressions 78 and 84, while they may relax gradually over time, remain in the material so that the inner layers 66*b–*66*d* remain compressed. The radius of the depressions or creases, as discussed above, have a radius R which is substantially equal to the thickness of the material. Accordingly, the depression 78 allows the inner layers to be folded about a pivot point defined by the center C of the depression while one or more of the outer layers 66*a,b* stretches as the material is folded. Since the radius of the depressions 78 84 is equal to the thickness of the material, the panels may be folded over so that the sections a and b on either side of the depression 78 may be folded against one another when the material is folded as indicated by the arrows X. As indicated in FIG. 16, the material may be folded so that the sections of the material between the depressions are folded over on one another as described above. As indicated in FIG. 17, the compression of the inner layers also allows for a less severe fold, such as the 90° fold illustrated in FIG. 17. The 90° fold illustrated in FIG. 17 is useful to fold the multiple ply corrugated material to form a transport container as illustrated in FIGS. 18–24.

Referring now to FIGS. 18–24, a transport container generally indicated by the numeral 86 includes a conventional wooden pallet 88 in which side edge members 90 and a center support member 92 support a raised wooden platform 94 off of the ground in order to define openings 96 which are adapted to receive the forks of a fork lift truck. According to the invention, a sheet 98 of multiple ply corrugated material of the same general type discussed above is creased and folded as described above to define corners 100, 102, 104 and 106. Accordingly, material 98 is divided into a first pair of opposed side walls 108, 110, and a second pair of opposed side walls 112, 114, which are connected at the corners to the first pair of opposed side walls. The ends of the sheet 98 are joined together as at joint 116 at a point intermediate the corners 104, 106.

Figures 18, 19, 20, 21:
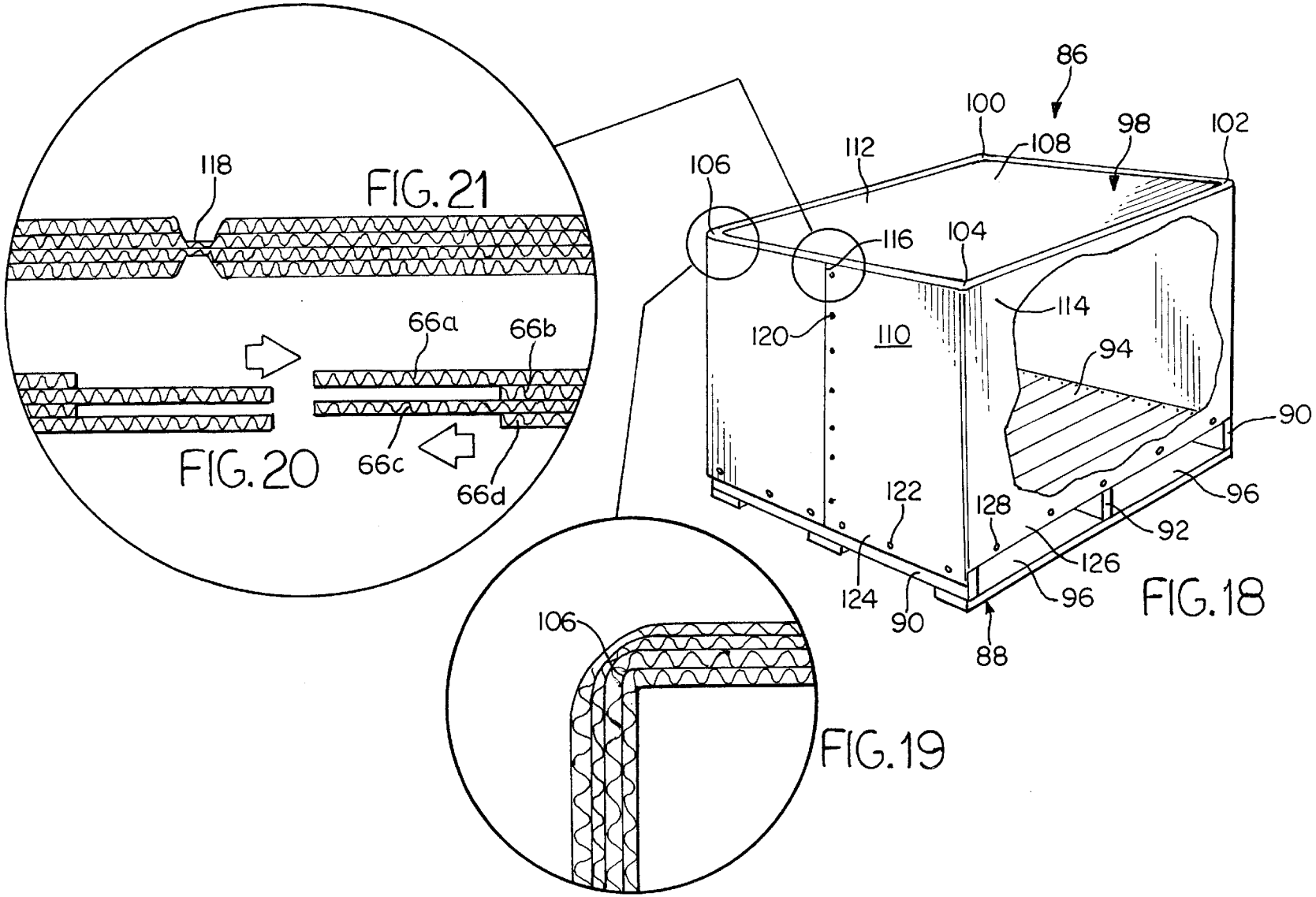
FIG. 18 is a view in perspective, with one wall partially broken away of a transport container made pursuant to the teachings of still another aspect of the present invention.
FIGS. 19 is an enlargement of the corresponding circumscribed portion of FIG. 18.
FIG. 20 is an enlargement of the corresponding circumscribed portion of FIG. 18, taken just before the ends of the corrugated material are inserted within one another to form a connection.
FIG. 21 is an enlargement of the corresponding circumscribed portion of FIG. 18.
Figure 22:
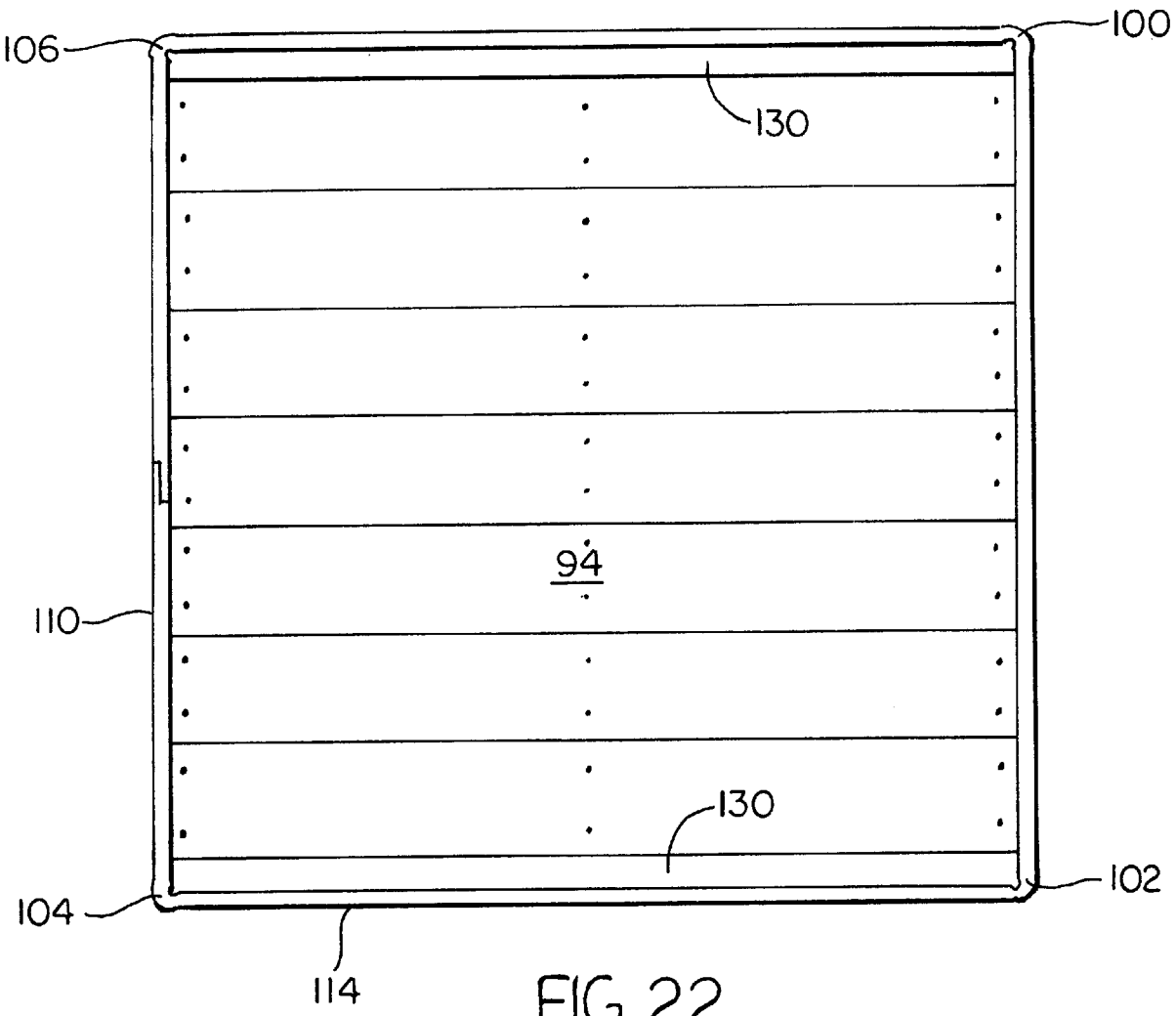
FIG. 22 is a top plan view of the shipping container illustrated in FIG. 18.
Figure 23:
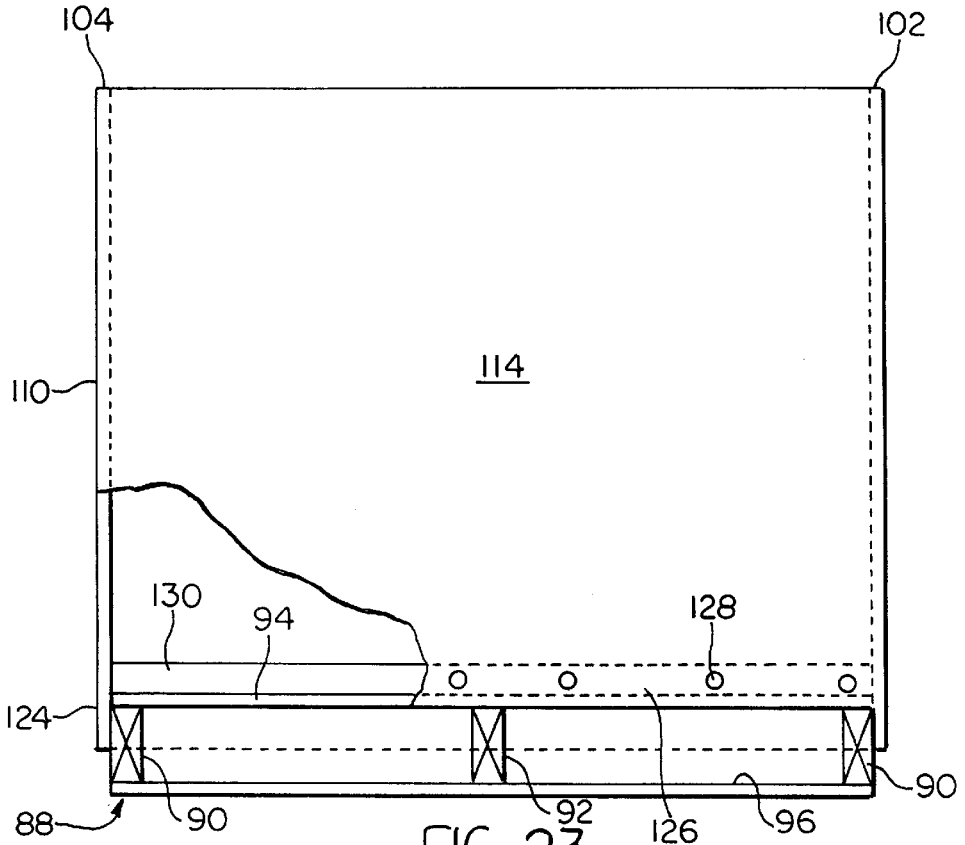
FIG. 23 is a side elevational view, with the wall partly broken away, of the shipping container illustrated in FIGS. 18 and 22.
Figure 24:
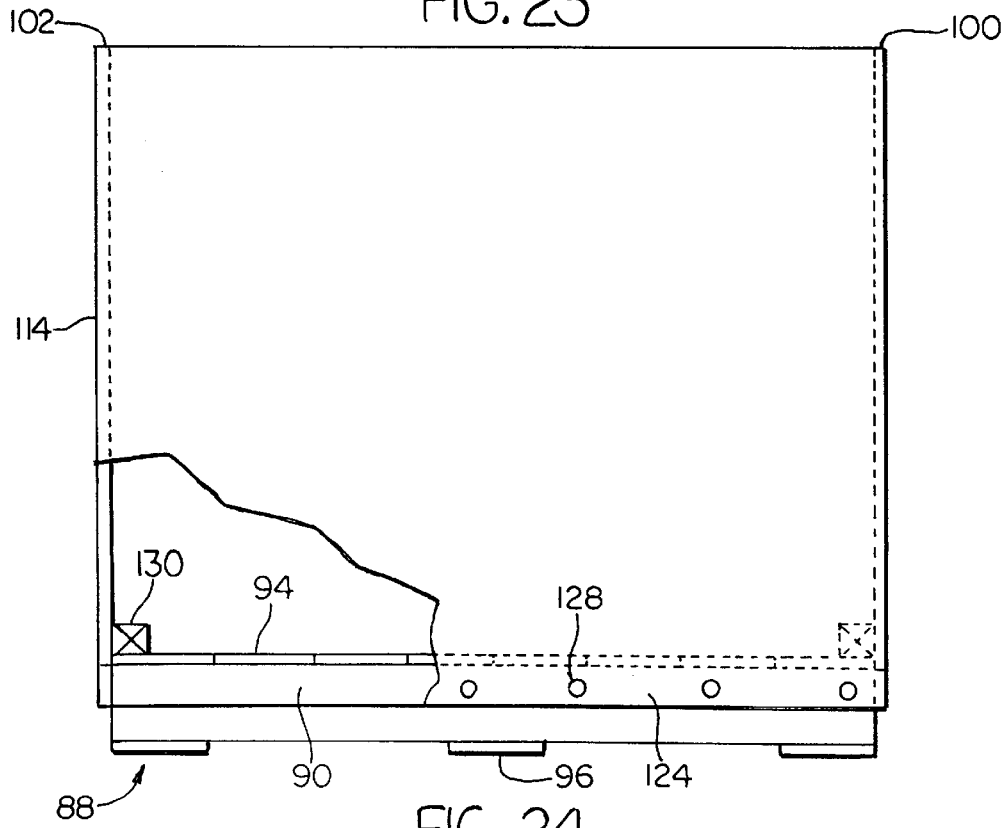
FIG. 24 is a view similar to FIG. 23, but taken from the side of the transport container adjacent the side illustrated in FIG. 23.

The joint 116 is formed as indicated in FIGS. 20 and 21. The plies 66*a*, 66*c* are cut back on one of the edges and plies 66*b*, 66*d* are cut back on the other edge to form the tongue and groove connection illustrated in FIG. 20. The ends are interlocked, and ultrasonically welded together as indicated at the ultrasonic weld 118 in FIG. 21. Fasteners 120 may be used to reinforce the joint.

The walls 108, 110 are secured to the side supports 90 by fasteners 122 which extend through the lower margin 124 of the side walls 108 and 110. The lower margin 126 of the side walls 112, 114 are cut back as illustrated to provide unimpeded access to the openings 96. Fasteners 128 extend through the margin 126 and into mounting blocks 130, which are secured to the platform 94 adjacent the corresponding edges thereof to receive the fasteners 128. Accordingly, the walls 108–114 cooperate with the platform 94 to define a receptacle for receiving products. The material 98 can be creased, folded, and the seam 116 applied. The material 98 can then be collapsed by moving diagonally opposite corners 100, 104 or 102, 106 against one another, thereby folding the side walls flat for transport to the place where the receptacle is to be used. The receptacle can then be formed by mounting the side walls on the pallet by installing the fasteners 122 and 128 as described above.

What is claimed:

1. Ventilating material for covering a vent opening in a roof of a building structure packaged for transport to the structure for installation on the roof comprising an elongated run of said venting material having passages extending there through to provide venting of the structure through said vent opening and the passages when the run of venting material is installed on the roof over the vent opening, said run of venting material being gathered into multiple interconnected layers to condense said run of venting material for transport to the building structure, one of said multiple layers constituting an outer layer, first fastening means for securing some of said layers not including said outer layer together, and second fastening means securing all of the layers together to permit the venting material to be transported to the roof and the outer layer secured to said roof after the second fastening means is released while the layers secured by the first fastening means remain secured together.

2. Ventilating material as claimed in claim 1, wherein said first and second fastening means are banding straps, the banding strap constituting said first fastening means being shorter than the banding strip constituting said second fastening means.

3. Ventilating material as claimed in claim 1, wherein said run of ventilating material includes multiple panels, each of said panels being folded about an end of an adjacent panel to overly the adjacent panel when the run of ventilating material is gathered for transport, two of said panels defining end panels with the remaining panels between the end panels, one of said end panels constituting said outer layer.

4. Ventilating material as claimed in claim 3, wherein said first fastening means securing panels other than said one end panel together, said second fastening means securing all of said panels together.

5. Ventilating material as claimed in claim 3, wherein said ventilating material includes multiple plies having opposite sides defining a longitudinally extending gap there between, one of said plies defining one side of the ventilating material extending across said gap to secure the vent parts together, the other side of said material being defined by said vent parts and said gap, said second fastening means securing said one end panel with said opposite side facing away from the other panels.

6. Ventilating material as claimed in claim 5, wherein said first fastening means securing panels other than said one end panel together, said second fastening means securing all of said panels together.

7. Ventilating material as claimed in claim 1, wherein said run of ventilating material is rolled into a roll having concentric layers concentric about a center, said outer layer being constituted by the outer concentric layer of said roll, said first fastening means securing some of said concentric layers not including the outer concentric layer together, the second fastening means securing all of said concentric layers together.

8. Ventilating material as claimed in claim 7, wherein said first fastening means extends radially outwardly from said center over edges of said concentric layers fastened together by said first fastening means and then transversely between a predetermined pair of said concentric layers, said second fastening means extending radially outwardly over an outwardly facing side of said outer concentric layer.

9. Ventilating material as claimed in claim 8, wherein said first and second fastening means are banding strips.

10. Ventilating material as claimed in claim 8, wherein said ventilating material includes multiple plies arranged into a pair of elongated vent parts defining a longitudinally extending gap there between, one of said plies defining one side of the ventilating material extending across said gap to secure the vent parts together, the other side of said material being defined by said vent parts and said gap, said second fastening means securing said one end panel with said opposite side facing away from the other panels.

11. Ventilating material as claimed in claim 10, wherein said roll is rolled with said gap facing radially outwardly.

12. Method of installing a ventilating cap on a roof of a building structure covering a vent opening in the roof, comprising the steps of transporting a bundle of ventilating material to said roof, said bundle of ventilating material being gathered into multiple interconnected layers for transport, one of said multiple layers being an outer layer, said bundle being secured by first fastening means securing some of said layers not including said outer layer together and second fastening means securing all of the layers together, releasing said second fastening means but not said first fastening means to release at least said outer layer while other of said layers remain bundled together by said first fastening means, securing at least said outer layer to said roof over said vent opening, releasing said first fastening means after at least said outer layer is secured to the roof to release the other layers, and installing fasteners securing the remaining layers to the roof.

13. Method of installing a ventilating cap as claimed in claim 12, wherein said material includes multiple plies arranged into a pair of elongated vent parts defining a longitudinally extending gap there between, one of said plies defining one side of the ventilating material extending across said gap to secure the vent parts together, the other side of said material being defined by said vent parts and said gap, said second fastening means securing said one end panel with said opposite side facing away from the other layers, said method including the step of unfolding said outer layer from said bundle to a position on said roof covering the vent opening without turning over the bundle.

14. Method of installing a ventilating cap as claimed in claim 12, wherein said layers are laid out along the ventilating opening after said first fastening means is released to form a continuous run of material restrained in place by said fasteners securing the outer layer before fasteners are installed securing the remaining layers to said roof.

15. Method of installing a ventilating cap as claimed in claim 12, wherein said ventilating material includes multiple panels, each of said panels being folded about an end of an adjacent panel to overly the adjacent panel, said method including the steps of unfolding one of the panels released by release of the second fastening means and positioning said one panel on said roof over the ventilating opening, securing said one panel to the roof while the remaining panels remain secured together by said first fastening means, releasing the first fastening means after said one panel is secured to the roof, positioning the remaining panels other than said one panel on said roof over the ventilating opening, and securing said remaining panels to the roof.

16. Method of installing a ventilating cap as claimed in claim 12, wherein said ventilating material is rolled into a roll having concentric layers concentric about a center, said outer layer being constituted by the outer concentric layer of said roll, said first fastening means securing some of said concentric layers not including the outer concentric layer together, the second fastening means securing all of said concentric layers together said method including the steps of unrolling one or more layers released by release of the second fastening means, positioning said layers released by the release of the second fastening means on said roof over the ventilating opening, securing said one or more layers to the roof while the remaining layers remain secured together by said first fastening means, releasing the first fastening means after the one or more layers released by the second fastening means are secured to the roof, positioning the remaining layers on said roof over the vent opening, and securing said remaining layers to the roof.

* * * * *